United States Patent [19]

Shiau

[11] Patent Number: 4,574,540

[45] Date of Patent: Mar. 11, 1986

[54] STRUCTURAL SUPPORT SYSTEM FOR MINIMIZING THE EFFECTS OF EARTHQUAKES ON BUILDINGS AND THE LIKE

[76] Inventor: Jgi-Jiang Shiau, 3010 Persimmon Pl., Fullerton, Calif. 92635

[21] Appl. No.: 542,463

[22] Filed: Oct. 17, 1983

[51] Int. Cl.[4] ..... E02D 27/34

[52] U.S. Cl. ..... 52/167

[58] Field of Search ..... 52/167, 299

[56] References Cited

U.S. PATENT DOCUMENTS

| | | | |
|---|---|---|---|
| 3,638,377 | 2/1972 | Caspe | 52/167 |
| 3,906,689 | 9/1975 | Nakayama | 52/167 |
| 4,179,104 | 12/1979 | Skinner | 52/167 |
| 4,409,765 | 10/1983 | Pall | 52/167 |

*Primary Examiner*—Henry E. Raduazo

[57] ABSTRACT

An improved building support system for minimizing the effects of strong seismic shocks to building structures transmitted through the earth to the foundation of the building structure, by laterally isolating the building base support structures from earth movements, comprising a first set of sliding bearing plates operably coupled to the base of the support columns of the building structure, a second set of sliding bearing plates fixedly mounted to the foundation and disposed in complementary sliding relationship to the first set of sliding bearing plates, a plurality of flexural members each fixedly coupled intermediately thereof to the support columns, and each flexural member being pivotally anchored at the ends thereof to a mounting post, each mounting post being moveably disposed along the longitudinal axis of the flexural members to which the mounting posts are secured and having a pair of apertures therein with bolts therethrough whereby said improved building support system provides a means for permitting system movement without failure of the support system.

13 Claims, 8 Drawing Figures

STRUCTURAL SUPPORT SYSTEM FOR MINIMIZING THE EFFECTS OF EARTHQUAKES ON BUILDINGS AND THE LIKE

BACKGROUND OF THE INVENTION

1. Field of the Invention

The present invention relates generally to the construction of load bearing structures to resist destruction during earthquakes, and more particularly, it relates to a support system able to minimize seismic effects.

2. Description of the Prior Art

Throughout the world and especially along the Pacific Coast of the Continental United States of America, including Mexico, and in many sections of the Southern Hemisphere, including the South American countries, earthquakes are very common occurrences. In fact, in the islands of the Pacific Ocean, many of these seismic disturbances occur at regular intervals. The strong seismic disturbances, or earthquakes, frequently result in a substantial loss of human lives and building failures.

Earthquakes comprise horizontal and vertical ground shocks or seismic vibrations. During an earthquake, structures such as buildings and the like, which are connected to the earth by conventional foundations, are subjected to forced vibrations due to the induced forces in their foundations. The inertia of the building structure tends to greatly resist such earthquake-induced movements transmitted from the earth to the foundation of the building. As a consequence, a lateral shearing force, that is, base shear, is applied to the structural body at its foundation. The magnitude of this base shearing force is clearly a major factor in earthquake damage and has long been the principal problem faced by the structural engineer in designing a building. Such forces to which a structural body are subjected during such seismic disturbances are, based on specific dynamic characteristics of the structure and for all practical purposes, directly portional to the weight (mass) of the structural body and, therefore, the deleterious effects of an earthquake can be minimized to some degree by the use of light-in-weight construction materials and by designing structures of relatively low total weight. However, the structural design engineer is constrained in this approach because of both the limited choices and relatively high cost of current commercially-available materials for use in this application.

Further, in some structures, such as a nuclear power facility, damage caused by earthquakes constitutes a special safety problem because of the possibility that nuclear materials may be released. Beyond the well-recognized understanding that such nuclear materials are radioactive and such radioactivity poses a significant problem to life, in general, it is little-known, high toxicity and poisonous characteristics of nuclear materials. For these, and other reasons, such a structure must have a substantially higher safety factor when it is built to eliminate the likelihood of exposing the surrounding population to toxic products and excessive radiation.

Structural failures in buildings, and the like, occur when extreme earthquake forces and earth displacements are transmitted to columns or posts via footings.

One reason for such failure lies in the inability of connections between columns and footings to sufficiently isolate the building from lateral movement of earth, that is, movement which is generally transverse to the column height direction.

In the prior art, there exists several ways to build buildings which increase the probability of the building surviving an earthquake. Such structures typically address the problem by attempting to provide a building structure which will survive such a seismic attack.

One of the structural design approaches used in the prior art was to utilize currently available commercial materials and to simply increase the size of all structural members so that it could withstand an earthquake of a certain prescribed seismic intensity. However, earthquakes do not have a predetermined approach to its effect upon the building or structure. The typical rapidly reversing forces inherent in the earthquake create such an effect upon the structure that it effects internal and external portions of the building and its structure. On the other hand, the present prevailing approach depends on elasto-plastic behavior of building structure to simply prevent the collapse of the building. However, this approach allows structural and nonstructural damages and permanent deformations, which may be acceptable as far as the building code goes, but may be unacceptable from a practical use/aesthetic standpoint.

As can be readily observed, however, the basic problem is how to isolate the building or structure from the devastating effects of strong earthquakes, since simply increasing the structural strength of the building, or depending on plastic deformation of the building structure, would anticipatorily fail as a satisfactory solution to the problem.

Those prior art devices known to the inventor herein are United States Patent Number:

U.S. Pat. No. 2,055,000
U.S. Pat. No. 3,350,821
U.S. Pat. No. 3,730,463
U.S. Pat. No. 3,762,114
U.S. Pat. No. 4,187,573
U.S. Pat. No. 4,222,206
U.S. Pat. No. 4,328,648
U.S. Pat. No. 4,330,103

However, none of the above-identified patents are considered to be similar to the present invention disclosed herein with the possible exception of U.S. Pat. No. 4,328,648.

U.S. Pat. No. 4,328,648 relates to means for protecting structures from earthquakes, explosions, cyclones and other sources of sudden external shock, said means including (as shown in FIG. 1), a support system comprised of a base 28, a pedestal 39, hanger rods 44, and an elastomer element 36. The fundamental purpose of the means disclosed in this patent is to isolate a building from the effects of seismic shock which may be transmitted through the building's foundation to the structure forming the building. One of the many problems posed by this invention and its application for the purposes intended relates to the fact that, as shown in FIG. 4 of the Drawings, the open side of the socket 47 where a hanger rod 44, which is threadably coupled with the ball bearing 43 via the threaded engagement indicated at 46 is captively secured within the socket formed in the base 47. When movement occurs, the operation of this system may possibly be impaired due to overstress near the edge. The overstressing referred to herein specifically relates to the overstressing which would occur due to the stress concentration found at the point of contact between the ball bearing 43 and the socket edge (most nearly identified by number 48 in FIG. 4). Further, such stress concentration would also exist in the reduced section around the edge 48. The failure of the support system means the destruction of the building. Additionally, it should be clearly noted that the shock insulation means disclosed in this patent possesses no inherent movement dampening effect, and attempts to isolate a building or structure from seismic shock effects by simply depending on the pendulous motion inherent in this structure, and, as a consequence, there exists no means for controlling highly deleterious and unacceptable harmonic vibration components. In fact, such harmonic vibration components can result in the damage of nonstructural items in the building and cause human discomfort.

U.S. Pat. No. 4,187,573 also teaches and discloses the use of an elastomer pad as an inherent, and, substantially essential part of the seismic isolation means disclosed in the patent.

In fact, it is well-known in the prior technical literature that various schemes have been attempted which employ the soft first story concept as a means by which to permit lateral movement of the support structure subjected to seismic activity and to absorb some of the energy produced thereby. However, the use of the soft first story concept has largely been demonstrated to be unfeasible for the reasons summarized in a technical article written by K. Staudacher in the "Proceedings of the Structural Engineers Association of Southern California," 1983, entitled "The Swiss Full Base Isolation System (3D) for Extreme Earthquake Safety of Structures." The article emphasizes the use of rubber bearings as building isolators rather than the soft first story concept.

Basically, the use of such elastomer pads, such as rubber, as base isolators raises significant questions about public safety. Buildings are extremely heavy in weight. In using such elastomer pads underneath the supporting columns and on top of the foundation, the building is, in fact, being supported on the elestomer pads. Should the pads malfunction, or in the event of an unexpectedly strong earthquake, such could practically postulate the failure of the elastomer isolator. Following such failure, the building will drop from a height equal to the thickness of the elastomer pad. The anticipated net effect of such an impact would result in the destruction of the building and likely lead to the total collapse of the building.

It is for these problems, and reasons, as well as the many others which are clearly set forth hereinafterwards that the instant invention was developed to solve.

SUMMARY OF THE INVENTION AND OBJECTS

Fundamentally, the present invention relates to a resilient structural support system and base support system for buildings, and the like, which is able to minimize the effects of seismic shocks which are transmitted to such structures via earthquakes.

In the conventional structural support design, structures are rigidly fixed to their foundations which move in correspondence to ground movements. Seismic shocks, such as are associated with earthquakes, are directly transmitted through the foundational base of the building structures. Such seismic shock transmission is due to the unyielding frictional forces which exist between the building structure and its foundation. Such frictional forces, and lack of yieldedness, are eliminated by the present invention.

In this invention, sliding bearing plates are employed which, while providing a loading bearing surface upon which the weight of the building rest, are practically free to move laterally across each other's surfaces which are formed of low friction material. One part of the bearing surfaces is coupled to the foundation; the other is coupled to the base of the building structure which rests on the foundation. If the bearing surfaces move with respect to each other, this will result in relative displacement between the building structure and the foundation. Such displacement must have a means whereby such relative displacement is restored to its former position. In order to accomplish this task, a structure is supported at its base in the horizontal principal directions of the structure by a resilient support system. The purpose and function of this system provides adequate strength to support the structure while being flexible enough to minimize seismic shocks being transmitted into the structure from the earth supporting the foundation; subsequent to the sliding of the structure. This resilient support system consists of a group of component modules for the system.

In order to apply these component modules to a given or a particular building, however, proper arrangements and/or combinations of the component modules must be determined from a seismic analysis of the structure to which this system is to be applied.

One object of the present invention is to reduce the effect of strong seismic shock on structures having a foundation, such as buildings.

Another important and primary object of the instant invention is to provide an improved building support system for minimizing seismic shock by insuring the constant distance between columnar supports and by permitting lateral movement within defined limits at the structural support level, including the foundational base.

A yet still further important object of the present invention is to provide a seismic shock minimizing support system for buildings and the like which does not utilize any elastomer pad, such as rubber.

An object of the instant invention disclosed and set forth herein in detail is to provide a unique means for effectively isolating a building structure from seismic shock effects.

The foregoing as well as other objects and advantages inherent in the invention will become more evident from the following detailed description of one suitable embodiment of the invention and from the accompanying drawings wherein:

DESCRIPTION OF THE PREFERRED EMBODIMENT OF THE INVENTION

Figure 1:
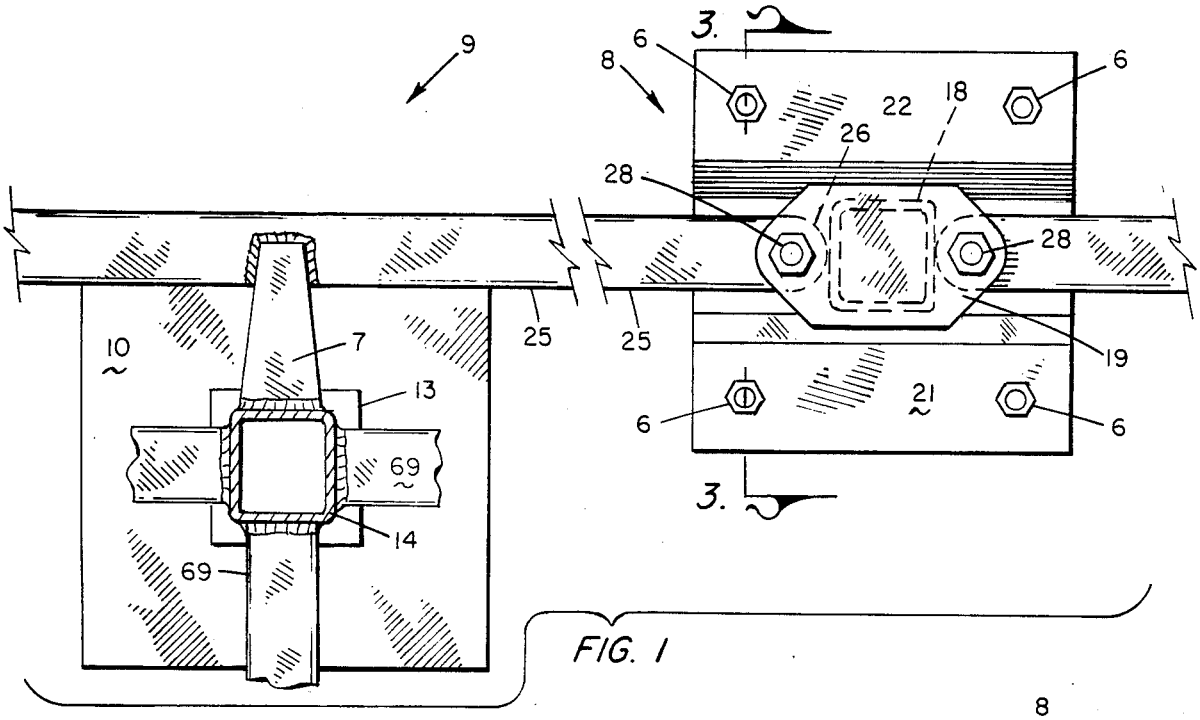
FIG. 1 is a view of the two component modules which comprise the present invention described herein depicting their attachment to the support columns of the building structures.

This invention relates to a resilient structural support system and building base design for structures, such as buildings, which minimizes the effects of strong seismic shocks on the building which is transmitted thereto via the foundation upon which the building is situated.

In conventional structural designs, the support structures of buildings are rigidly fixed to their foundations which move with respect to the ground or earth upon which the foundations are situated. Seismic shocks through the earth are directly transmitted through the foundation of the building to the support structure of the building. In other words, such conventionally designed structures are direct receipients of seismically produced ground shocks, such as are typically produced by massive earth shifts or movements. The direct transmission of such shocks is due primarily by the unyielding friction forces which exist between the structure and its foundational base.

When a strong earthquake occurs, the ground movements, as previously stated, which produce the greatest amount of damage to a building and its associated support structure, is the lateral or horizontal earth movement. During an earthquake, the foundational structure of the building, which is formed typically of reinforced concrete, is abruptly displaced laterally with its supporting ground. Since the building structure is rather heavy and massive, it, under the laws of physics, tends to stay in its at-rest, non-moving position. This inertial characteristic of the building structure creates a tremendous shear force between the base of the building structure and the concrete foundation. Such shear force, sometimes referred to as "base shear", tends to cause the base of the building to rapidly move in the direction of the earthquake-produced base shear force while the rest of the building structure tends to resist such rapid movement. As a consequence, a whip-like force is applied to the building and its support structure system. Such a whip-like force causes the building to move similar to a relatively taunt string held between two hands at its ends, and then plucked. The resulting movement of the building and its support structure will contain areas or planes where the effective movement tends to be zero, i.e., no displacement, and areas or planes where the movement is maximal, i.e., great displacement. It is this induced whip-like force which tends to force the building and its support structure system to move in a fashion which may easily exceed the structural survival design parameters to which the particular building and its structure were built. Consequently, it is quite clear that if the base shear force were eliminated, or at least, substantially minimized, damage to the building and the structural support system would be eliminated or significantly minimized. The present invention is primarily designed to eliminate and/or significantly minimize such base shear force generated by strong seismic movements.

The invention disclosed and discussed herein minimizes such strong shock effects by the use of sliding bearing plates which provides bearing capacity by which the building is supported, while at the same time, incorporating a very low friction on the bearing plates. Basically, the bearing surfaces are separately connected to the support structure of the building and to its foundation in order to form a sliding surface between the support structure of the building and its associated foundational base.

Subsequent to the point of sliding at the base, there will, of course, be a relative displacement in the direction of sliding between the structural support system and its foundational base. In order to restore the structural support to the original position prior to the displacement generated by seismic motion with respect to the foundation, the structure is supported at its base principally in two horizontal directions relative to the structure by a relatively resilient lateral support system. This lateral support system basically provides adequate strength to support the structure while being flexible enough to minimize shocks being transmitted into the overall structure which supports the building, subsequent to the sliding of the structure laterally.

The resilient lateral support system consists of a group of component modules for the combined support system. By arranging the combinations of component modules can be ascertained from a seismic analysis of the structure. It should be noted, however, that there may be cases for which the low base friction alone is adequate to transmit the shear forces which exist at the base, that is, the foundational base upon which the structure of the building rests, when the building is subjected to design wind loads or other lateral forces impressed upon the building. For this reason, the support system described herein must be checked against those loadings.

It should be clearly understood that because of the substantially low base friction and flexibility of the resilient support system set forth herein, the fundamental frequency and the response of the building which utilizes this structural support system will be relatively low, and, accordingly, the effects of seismic shocks upon the building as well as damages of nonstructural items, including the precious articles such as are displayed in museums and the valuable apparatus in laboratories or hospitals will likely be greatly minimized. This implies that this invention insures that the building structure remains elastic without being esstentially subject to damage or sustaining permanent deformations either in structural or nonstructural items after strong earthquakes, depending on the minimization of the strong earthquake effects.

Figure 2:
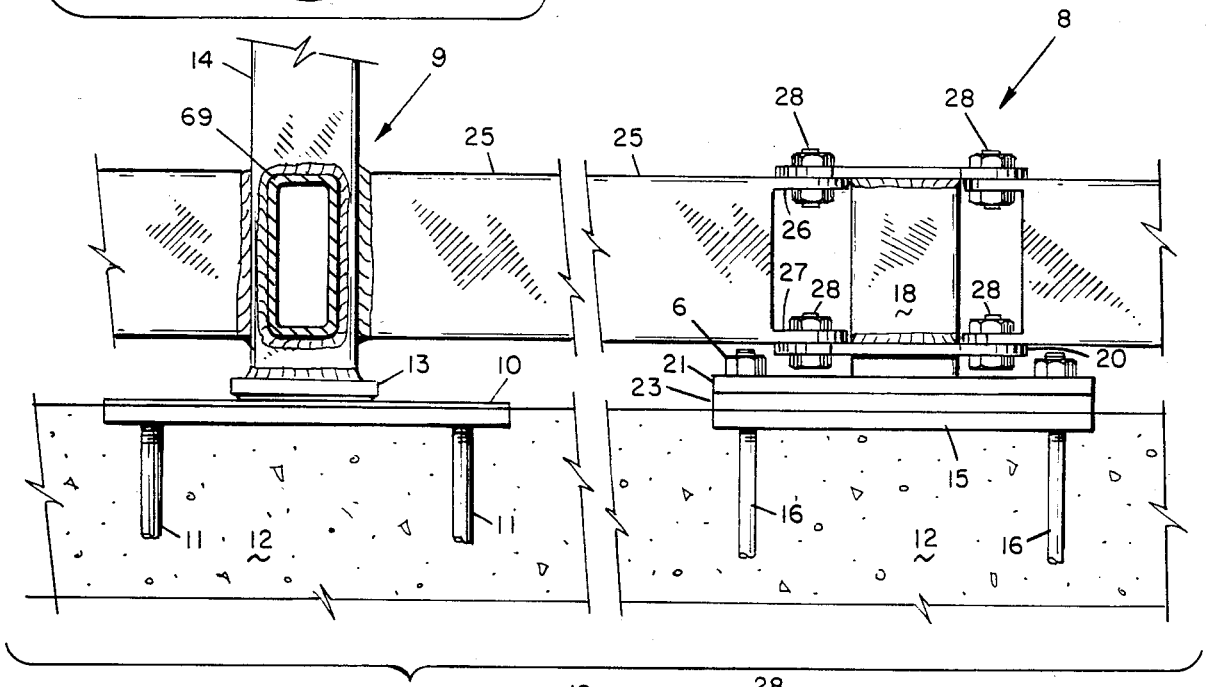
FIG. 2 is a side elevational view of the two modules illustrated in FIG. 1.
Figure 3:
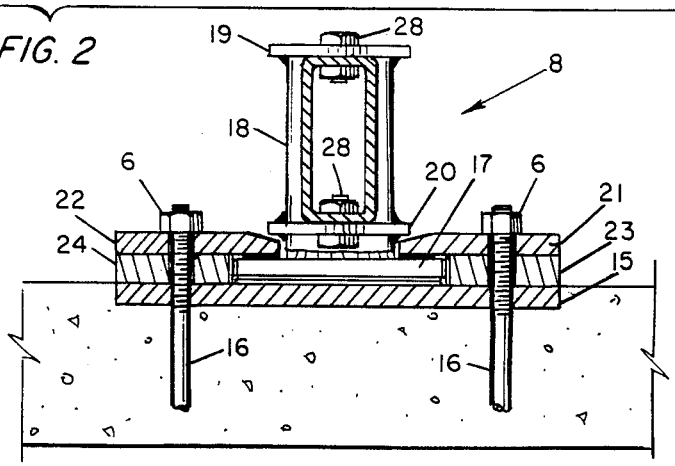
FIG. 3 is a view of one of the modules of FIG. 1 taken along Plane 3—3 thereof.

With continued reference now to the drawings herein, and with special emphasis now on FIGS. 1 and 2, there is shown and illustrated the resilient support system which comprises a first component module, generally indicated at 9, including a first bearing plate 10 having a plurality of anchoring bolts 11 fastened with tapped apertures in the first bearing plate 10 and imbedded in the building foundation 12, which is typically formed of concrete, a second bearing plate 13 being disposed on top of the bearing plate 10 in slideable relationship thereto, a second component module, generally indicated at 8, including a third bearing plate 15 having a plurality of anchor bolts 16 passed therethrough via apertures therein and embedded in the building foundation 12, a fourth bearing plate 17 secured to the bottom of a mounting post 18 which is rigidly supported in the transverse relationship to the flexural member 25 and operably disposed to practically freely slide along the longitudinal axis of the flexural member 25, a pair of flanges 19, 20 with each having a pair of oppositely-disposed apertures therethrough secured to the mounting post 18, a pair of plates 21, 22 disposed above the fourth bearing plates 17 and secured by means of spacers 23, 24 and flexural member 25 secured mediately along its length to the building support column 14 via the top and bottom connecting plates and having a pair of projecting tangs 26, 27 with apertures therethrough for mounting to the corresponding apetured flanges 19, 20 via fasteners 28, such as bolts, or threaded rods, and 21, 22, 23, and 24 are secured to 12 by 16.

Figure 5:
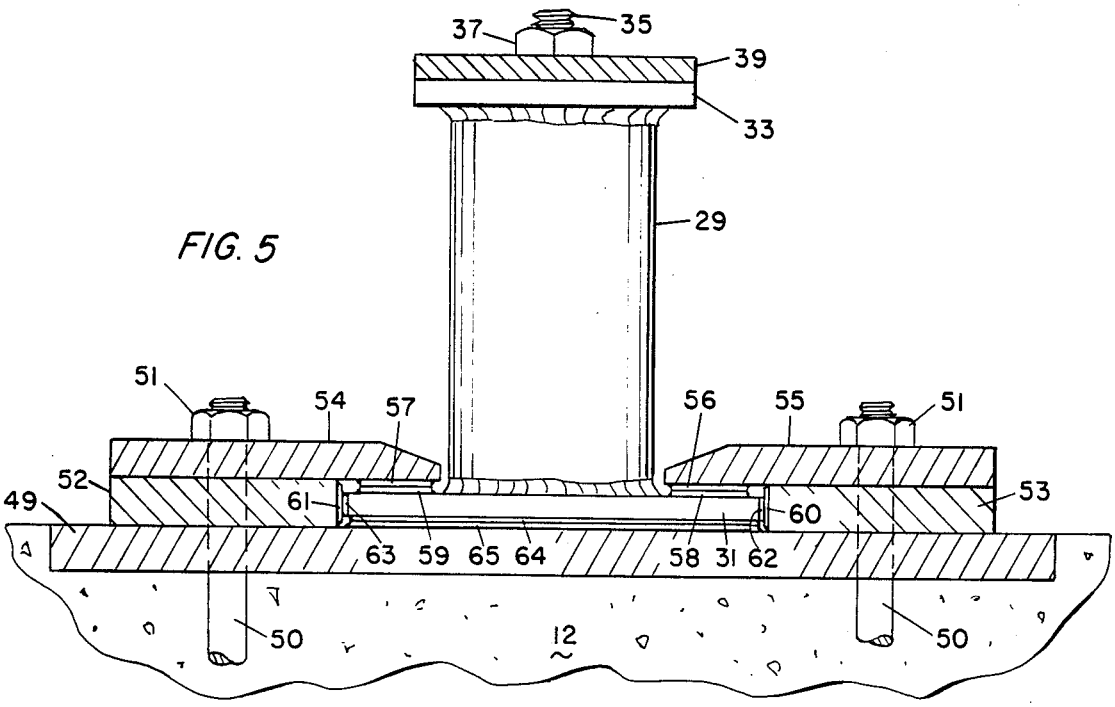
FIG. 5 is a view of the anchor structures of the invention as embodied in FIG. 4 taken along Plane 5—5 thereof.

It should be clearly noted and understood at this time that the use of the term "bearing plates" such as is used descriptively when referring to 10, 13, 15, 17, 31, 32, 49, 21, 22, 23, 24 etc., all contemplate the use of a relatively low friction surface existing between the various complimentary bearing surfaces, such as the coefficient of friction, $\alpha \leqq 0.1$. The range of $\alpha$ which is typically anticipated for the present application intended is from 0.02 to and including 0.10. This can be effectuated by at least two (2) different methods. One method is to simply use as material for the construction of such bearing plates material which inherently possessed such relatively low frictional surface characteristics. However, such material is very costly due to its specialized formulation and may also have strength or hardness characteristics, or both, which are unacceptable for most applications, such as anticipated for the present invention. Conceivably, however, it may well be that, in the future, the present science of metallurgy would advance to produce such low frictional characteristics along with the necessary strength and hardness requirements. On the other hand, in the present metallurgical environment, it is quite likely more practical to form such "bearing plates" by using the lower-in-cost and higher-in-strength steel as a base and to weld a thin sheet of what is termed in the trade as "sliding bearing" material. All of the contact surfaces would, of course, be covered with the sliding bearing material which would result in the bearing plate configuration as shown in FIG. 5 where all of the sliding surfaces are covered with this sliding bearing material. At this time, it is contemplated that the latter method of creating a sliding bearing plate be used to implement the present invention in a practical sense.

In further reference to the practical use of the within invention, of course, the first component module which is provided at all building support columns and work with a set of the second component modules to form the improved structural support system for minimizing the effects of earthquakes on buildings and the like, as will be discussed in further detail hereinafterwards.

As clearly set forth herein previously, upon the application of a seismic force to the structure, the primary damaging effect is typically produced by a horizontal or lateral force rather than by a vertical force.

It should be noted that the lateral reaction force of the flexural member 25 will be impressed upon the mounting post 18, the plates 21, 22, which are typically bolted to a third bearing plate 15 via the spacers 23, 24, serve to resist the overturning moment associated with the reaction force acting on mounting post 18 which is secured to a third bearing plate 15 which is fixedly anchored into the concrete foundation 12 via the anchoring rods 16.

It should be clearly understood and noted at this time that none of the mounting posts 18 supports the building's weight.

It should be noted that the spacers 23, 24 function additionally as shear keys. These shear keys resist the end shear of the flexural member which is transmitted through the mounting post. The shear key has, of course, a sliding bearing plate secured to the inner side of the spacers 23, 24 as depicted in FIG. 5 and identified respectively at 60, 61. Such is in further sliding relationship to the sliding bearing plates 62, 63 which are affixed to the base plate 31. Such force can only be applied transverse to the longitudinal axis of the flexural members 47 or 48.

Further, the capping plates 54, 55 are employed to restrain the mounting posts 29, 30 from being overturned, partiually by having the sliding bearing plates secured to the bottom to create a sliding relationship with the base plate 31 of the mounting post 29 the force creating the sliding relationship being along the longitudinal axis of the flexural member 47 or 48.

The sliding bearing plates are operably secured by welding or the like, to the five (5) side of the portions of the base plate 31, said sliding bearing plates being identified in FIG. 5 as 58, 59, 62 63, and 64. These sliding bearing plates are slideably related to the sliding bearing plates 57, which is weldably secured to cap plate 57, 61, which is weldably secured to shear key 52, 65, which is weldably secured to plate 49, 60 which is weldably secured to shear key 53 and 56 which is weldably secured to cap plate 55.

During lateral seismic displacement of the concrete foundation 12, the first bearing plate 10 and the third bearing plate 15 will move in the same direction as the seismic motion. After overcoming the frictional forces which exist between the pairs of bearing plates, i.e., 10 and 13 (to which sliding bearing plates have been separately secured thereto as previously discussed and disclosed hereinbefore), these bearing plates will slide or slip with respect to each other. In other words, when the applied base shear force exceeds the impressed frictional forces which exist between the pairs of bearing plates, the plates will slide with respect to each other and, thus, the seismic shock will be "filtered", by way of energy absorbsion, through the flexural members 25, thereby reducing the applied base shear force to a relatively insignificant magnitude. When such occurs, the effect of the base shear force is minimized, i.e., the "whipping" force will be minimized throughout the building and structural support system. When such is minimized, no damage will be sustained by the building or the building structural support system, thereby minimizing or eliminating the effect of the earthquake upon the building and its associated structural support system.

Figure 4:
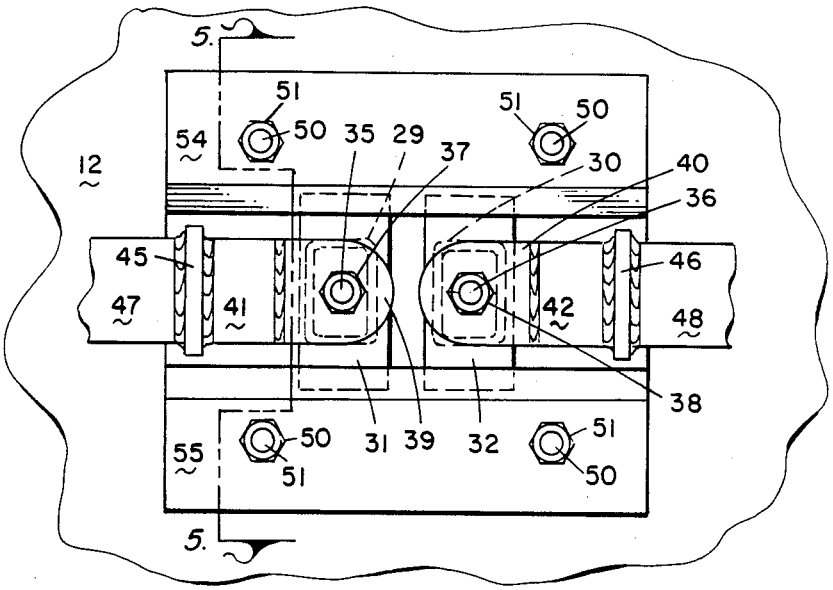
FIG. 4 is a plan view of an alternative embodiment of one of the component modules of the present invention illustrating the nature and purpose thereof.
Figure 6:
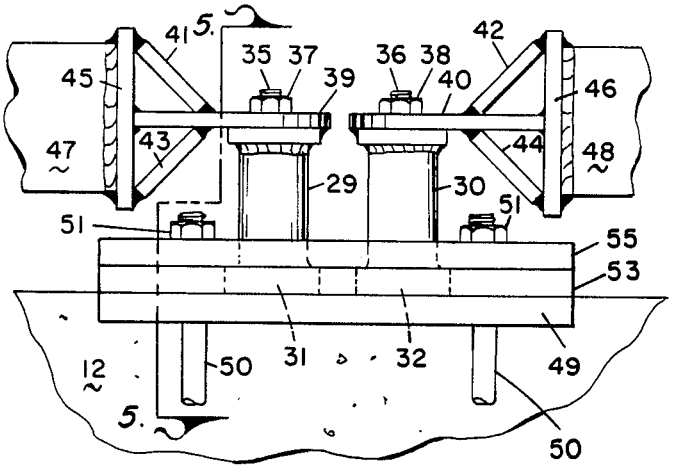
FIG. 6 is a side elevational view of the alternate embodiment of the invention as depicted in FIG. 4.
Figure 7:
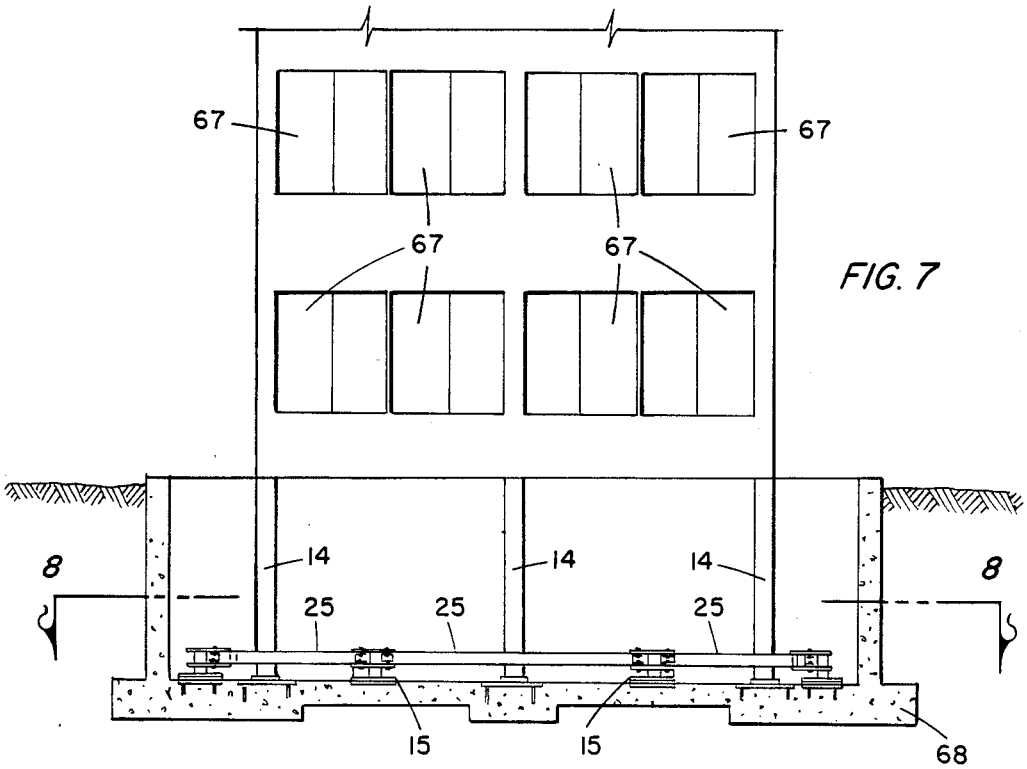
FIG. 7 is a vertical elevational view of the invention showing how it may be embodied in the support structure of a building.

With special emphasis now on FIGS. 4, 5 and 6, an alternative form of the present embodiment of the invention is illustrated. Basically, the alternate embodiment of the present invention depicts only a structural change in the second component module which is generally identified at 8 in FIG. 1. As illustrated in FIG. 4, instead of the single mounting post 18 as shown in FIGS. 1 and 2, there are two upstanding support members, which for the sake of clarity will be referred to herein afterwards as mounting posts 29, 30. Each mounting post 29, 30 is fixedly secured to a corresponding bearing base plate 31, 32. The opposite end of each of the mounting posts 29, 30 is capped with a cap plate 33, 34 having a tapped aperture therein for a fastener, such as a threaded rod and nut combination correspondingly identified at 35, 36, and 37, 38, which removably secures the apertured tangs 39, 40 to the mounting posts 29, 30. The tangs 39, 40 are fixedly secured by the welded plates 41, 42 and 43, 44 to end plates 45, 46 which are, in turn, welded to the ends of flexural members 47, 48.

The bearing base plates 31, 32 as shown in FIGS. 4 and 5 are disposed in initimate slideable juxtaposition to the bearing plates 49, 52, 53, 54, 55 which is fixedly mounted to the concrete building foundation 12 via a plurality of anchor bolts 50 and 51. The bearing base plates 31, 32 are constrained to move only in transverse relationship to the flexural members 47, 48 by means of the spacers 52, 53 and the capping members 54, 55 which extend over the ends of the bearing base plates 31, 32. As clearly seen in FIG. 5, the bearing plates 49, 52, 53, 54, 55 are capped with sliding bearing plates 65, 61, 60, 57, 36, each of which has a very low coefficient of friction and are placed in contact with the sliding bearing plates 59, 63, 64, 62 and 58, each of which also has a very low coefficient of friction and which are mounted by welding to bearing plate 31. Of course, bearing plate 32 has its own sliding bearing plate (not shown) in identical correspondence to bearing plate 31. It should be noted that while the plates are secured to one another by welding in this example, the plates could be approximately secured by means and methods other than welding, such as bonding with adhesives, clamped, bolted or riveted together, or any other appropriate method for securing said bearing plates.

A building 66 is shown in vertical elevation with windows 67, along with its associated foundation 68, typically formed of reinforced concrete. In practice, the building itself is formed of reinforced concrete with a structural steel frame system. The structural support system of the building 66 is supported on the foundation 68 by means of a plurality of building support column members 14 the bottoms of which are secured to bearing plates 13 (see FIGS. 1 and 2) which, in turn, rest in slideable relationship on bearing plates 10. Such columns are practically free to slideably move thereon in lateral directions.

However, as previously stated, such movement as induced by a typical earthquake will effectuate lateral movement only.

Each of the columns 14 are tied together in fixed relationship with each other by means of a tie beam 69. The ends of these tie beams 69 are fixedly attached (typically by welding) to the columns 14. The flexural members 25 are maintained in an elevated position above the foundation 68 by the mounting posts 18 via the bearing plates 15 anchored to the foundation 68 and the bearing plate 17 secured to the bottom of the mounting post. Flexural members 25 are connected to columns 14 with top 6 and bottom 7 plates (typically by welding).

DESCRIPTION OF THE RESULTING EFFECTS OF LATERAL FOUNDATION MOVEMENT, SUCH AS INDUCED BY AN EARTHQUAKE, UPON THE IMPROVED STRUCTURAL SUPPORT SYSTEM

The following word description of the relatively complex effects resulting from the impression of a lateral force generated by an earthquake which induces a foundational movement will now be attempted.

Figure 8:
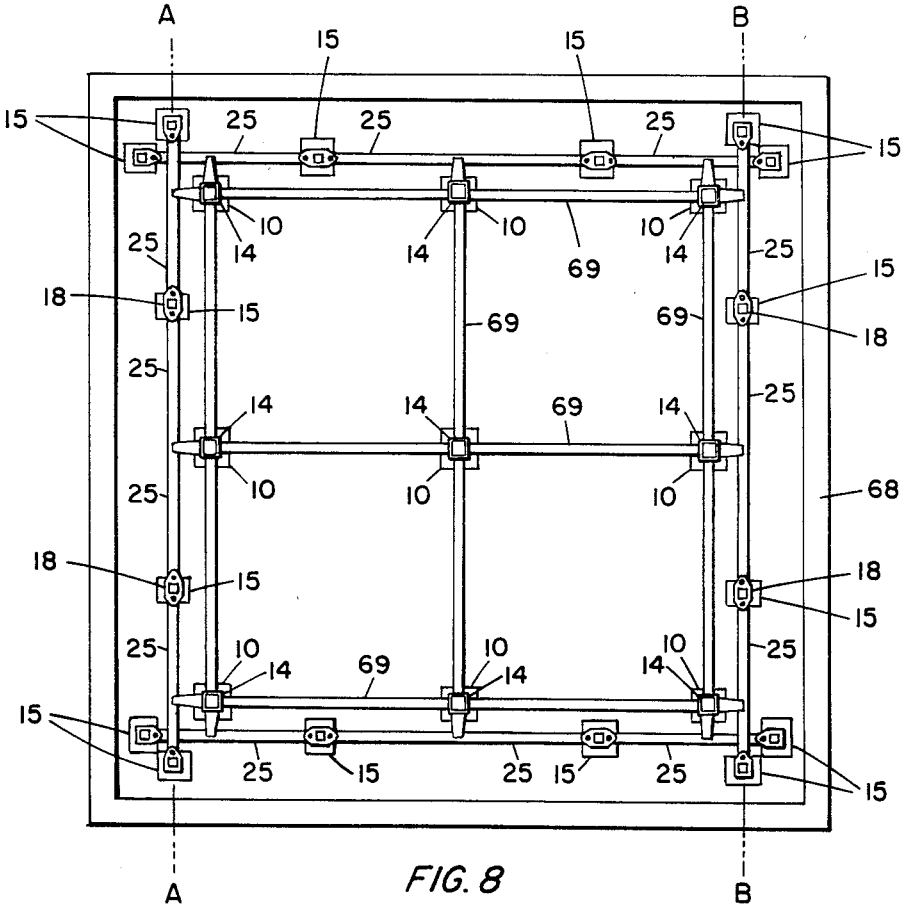
FIG. 8 is a view taken along Plane 8—8 of FIG. 7.

Referring now to FIG. 8, assume for a moment that a lateral force is impressed upon the foundation 68 producing movement of the foundation 68 to the left of the building center. Since all of the building support columns 14 are tied together in relatively fixed relationship to one another by means of the tie beams 69, the column bases will move as a unit subsequent to the movement in time when the lateral force overcomes the sum of the frictional forces under the bases of the columns 14, the flexural members 25, which are rigidly supported in the left-right direction, but are practically free to slide in the front-back direction of the building's orientation as reference by FIG. 5 and depicted as lying along horizontal axes A and B which are at the left and right of the building plan layout as shown in said FIG. 8, under these circumstances will filter the seismic shock and tend to bow to the left of the building. The flexural members 25 which are simply supported at opposite ends by mounting posts 18 have flexibility designed to greatly reduce the seismic shock transmitted via the building foundation 68, and, as a consequence, the lateral seismic force is limited to a very small magnitude. Following the earthquake, the strain energy stored in the flexural members 25 during the earthquake will restore the building 66 to its original position relative to its foundation 68. For an earthquake in a direction skewed to the horizontal principal axes of the building 66, both sets of component modules 8 and 9 which are aligned in left-right and front-back directions become active, and, it is for this reason, that the motion of the earthquake can be considered as the resultant motion of the two component earthquake motions along the two horizontal principal axes of the building 66.

Consequently, it can be readily seen that the base shear forces are minimized by permitting sliding movement of the column bases 14 of the first component module in the direction of the applied lateral force subsequent to the yielding of the frictional forces existing at the bases of the columns 14 and by greatly reducing the effects of seismic shock by using the flexural members 25 of the second component module to filter the seismic shock.

Additionally, it may be readily seen from the above description that the strain energy stored in the flexural members 25 of the second component module provides means for restoring the building and the building support structure system to its former at-rest position prior to the earthquake.

A more specific description of the functional interworking relationship of the various elements of the invention disclosed herein and its relationship to the building support structure can be ascertained from the following mathematical analysis.

SEISMIC ANALYSIS OF THE INTERPRETED STRUCTURAL SYSTEM

The equations of motion of structures subjected to ground motion prior to its base sliding can be expressed as follows:

$$[M]\{x\}+[K]\{x\}+[C]\{x\}=-x_g\{M\} \quad (1)$$

in which [M]=system mass matrix; [K]=system stiffness matrix; [C]=system damping matrix; {x}=acceleration vector relative to base {x}=displacement vector relative to base {x}=velocity vector relaive to base; and $x_g$=ground acceleration.

According to the modal synthesis approach.

$$\{x\}=[\Phi]\{A_n\} \quad (2)$$

in which $[\Phi]$=a square matrix containing all characteristics vectors such that the nth column is the set of characteristics displacements for nth mode; and $\{A_n\}$ =modal amplitude vector.

When the system modal dampings are defined, the system equations of motion can be transformed into the system modal equations of motion, which are written as follows:

$$A_n+2\beta_n\omega A_n+\omega_n^2A_n=-\Gamma_n x_g \tag{3}$$

For building structures, modal dampings are usually assumed constant for all modes. Thus, the system modal equations of motion can be expressed as:

$$A_n+2\beta_o\omega_n A_n+\omega_n^2A_n=-\Gamma_n x_g \tag{4}$$

The condition for structure to slide is: $\{M\}^T(\{x\}+x_g\{1\})>\alpha W$
in which $\alpha$ is of coefficient of friction between base of structure and its foundation and W is the total weight of the structure. The equations of motion of the structure become $$[M]\{y\}+[K]\{x\}+[C]\{y\}=-x_g\{M\} \tag{5}$$

in which $\{y\}=\{x\}+u\{1\}$; u=displacement of base of structure relative to ground (or foundation) and $x_g'(o)=x_g(t_s)$ $t_s$ is the time when the base of the structure starts sliding. The equation of motion of the base can be written in the following manner:

$$\{M\}^T(\{x\}+u\{1\})+k_s u+c_s\dot{u}=-\frac{W}{g}x'_g+\alpha W \tag{6}$$

In which $k_s$ is the stiffness of the flexural members 25. Thus, the equations of motion for the complete system can be expressed in a condensed form as follows:

$$[\overline{M}]\{v\}+[\overline{K}]\{v\}+[\overline{C}]\{\dot{v}\}=-\{\overline{M}\}x'_g+\begin{Bmatrix}\{0\}\\ \alpha W\end{Bmatrix} \tag{7}$$

in which $$\{v\}=\begin{Bmatrix}\{x\}\\ u\end{Bmatrix} \tag{8}$$

$$[M]=\begin{bmatrix}[M] & [M]\{1\}\\ \{M\}^T & \{M\}^T\{1\}\end{bmatrix} \tag{9}$$

$$[K]=\begin{bmatrix}[K] & 0\\ 0 & k_s\end{bmatrix} \tag{10}$$

$$\{\overline{M}\}=\begin{Bmatrix}\{M\}\\ \frac{W}{g}\end{Bmatrix} \tag{11}$$

By substituting Eq. (2) in Eq. (8), $$\{v\}=[Q]\begin{Bmatrix}\{A_n\}\\ u\end{Bmatrix} \tag{12}$$

in which, $$[Q]=\begin{bmatrix}[\Phi] & 0\\ 0 & 1\end{bmatrix} \tag{13}$$

Substituting Eq. (12) in Eq. (7) and premultiplying Eq. (7) by $[Q]^T$ $$[Q]^T[\overline{M}][Q]\begin{Bmatrix}\{A_n\}\\ u\end{Bmatrix}+[Q]^T[\overline{K}][Q]\begin{Bmatrix}\{A_n\}\\ u\end{Bmatrix}+[Q]^T[\overline{C}][Q]\begin{Bmatrix}\{\dot{A}_n\}\\ \dot{u}\end{Bmatrix}=-[Q]^T\{\overline{M}\}X'_g+[Q]^T\begin{Bmatrix}\{0\}\\ \alpha W\end{Bmatrix} \tag{14}$$

Thus, the equations of motion of the complete system can then be expressed in the following form:

$$[M]\{q\}+[K]\{q\}+[C]\{\dot{q}\}=-\{M\}X'_g+\begin{Bmatrix}\{0\}\\ \alpha W\end{Bmatrix} \tag{15}$$

in which $$\{q\}=\begin{Bmatrix}\{A_n\}\\ u\end{Bmatrix} \tag{16}$$

$$[M]=\begin{bmatrix}[\Phi]^T[M][\Phi] & [\Phi]^T[M]\{1\}\\ \{M\}^T[\Phi] & \{M\}^T\{1\}\end{bmatrix} \tag{17}$$

$$[K]=\begin{bmatrix}[\Phi]^T[K][\Phi] & 0\\ 0 & k_s\end{bmatrix} \tag{18}$$

$$\{M\}=\begin{Bmatrix}[\Phi]^T\{M\}\\ \frac{W}{g}\end{Bmatrix} \tag{19}$$

According to the modal synthesis approach $$\{q\}=\{\Phi'\}\{B_n\} \tag{20}$$

The generalized modal equations of motion can be written as follows:

$$B_n+2\beta_o\overline{\omega}_n\dot{B}_n+\overline{\omega}_n^2B_n=-\overline{\Gamma}_n x_g+W_n \tag{21}$$

in which $$\overline{\Gamma}_n=\{\phi'_n\}^T\{M\}/\{\phi'_n\}^T[M]\{\phi'_n\} \tag{22}$$

$$W_n=\{\phi'_n\}^T\begin{Bmatrix}\{0\}\\ \alpha W\end{Bmatrix}/\{\phi'_n\}^T[M]\{\phi'_n\} \tag{23}$$

According to Eq. (21), due to $W_n$, $$B'_n=W_n/\overline{\omega}_n^2 \tag{24}$$

$$B'_n=0 \tag{25}$$

When $\alpha$ is relatively small, for simplicity and within reasonable conservatism, $x_g'$ may be replaced by $x_g$. Thus, $$B_n + 2\beta_o\bar{\omega}_n\dot{B}_n + \bar{\omega}_n^2 B_n = -\bar{\Gamma}_n x_g \quad (26)$$

$B_n$ can then be calculated by the concept of response spectrum.

The above indicates that response spectral analysis of the integrated structure can be simplified by considering the maximum response of the structure equal to the sum of the following responses:

The responses, associated with yielding base friction force, calculated based on fundamental mode shape of the integrated structure in first stage.

The response calculated based on eigenvalues and eigenvectors of the integrated structure in second stage and original response spectrum.

Alternatively, the response can be solved by step-by-step numerical integration.

What is claimed is:

1. An improved building support system for minimizing the effects of strong seismic shocks to building structures having support columns transmitted through the earth to the foundation of the building structure, by laterally isolating the building base support structures from earth movements comprising:

(a) a first set of sliding bearing plates operably coupled to the base of the support columns of the building structure;

(b) a second set of sliding bearing plates fixedly mounted to the foundation and disposed in complementary sliding relationship to the first set of sliding bearing plates;

(c) a plurality of flexural members each fixedly coupled intermediately thereof to the support columns;

(d) a plurality of mounting posts pivotally coupled to the ends of each flexural member, and resting on the building foundation, each of said mounting posts being moveably disposed along the longitudinal axis of the flexural members to which the mounting posts are secured;

(e) means for restricting the movement of said mounting posts to displacement along the longitudinal axis of said flexural member affixed thereto, whereby said improvement building support system provides a means for permitting system movement without failure of the support system.

2. The improved building support system of claim 1, wherein said first set of sliding bearing plates is weldably secured to the bottom of each of the support columns.

3. The improved building support system of claim 1, wherein said second of sliding bearing plates in fixedly mounted to the concrete foundation by a plurality of rods depending from the underside of said plate which are embedded in said concrete foundation and anchored therein.

4. The improved building support system of claim 1, wherein said first set of sliding bearing plates is smaller in area than said second set of sliding bearing plates.

5. The improved building support system of claim 1 wherein said sliding bearing plates include:

(a) a sliding bearing plate of metal material having a frictional surface value of up to or less than 0.1;

(b) structural metal plate substantially coextensive with the sliding bearing plate of metal material, structural metal plate being fixedly secured to one-side of said sliding bearing plate.

6. The improved building support system of claim 1 wherein said flexural members are formed of steel box material.

7. The improved building support system of claim 1 wherein said flexural members are fixedly coupled mediately thereof to said support columns by welding.

8. The improved building support system of claim 1 wherein said pivotal coupling of the flexural members includes:

(a) flange means affixed to said mounting posts extending outwardly therefrom and having apertures therein;

(b) flange means affixed to the ends of said flexural members extending outwardly therefrom and having apertures therein; and (c) means for pivotally coupling said mounting post flange means to said flexural members flange means.

9. The improved building support system of claim 8, wherein said means for pivotally coupling said mounting post flange means to said flexural members flange means is a threaded bolt operably disposed through said apertures in said flanges on said mounting posts and said flexural members and captively secured by means of a nut threadably adapted for securement to said threaded bolt.

10. The improved building support system of claim 1, further comprising means for maintaining the building support columns in fixed, spaced apart relationship to one another.

11. The improved building support system of claim 10 wherein said means for maintaining the building support columns in fixed, spaced apart relationship to one another includes a plurality of steel beams fixedly connected to said support columns and spanning the distance between said support columns.

12. The improved building support system of claim 1 wherein said means for restricting the movement of said mounting posts to displacement along the longitudinal axis of said flexural member affixed thereto, comprising:

(a) a plurality of threaded rod members, one end of which is embedded in the building foundation and one end of which is passed through the corresponding apertures in said base plate;

(b) spacer means having apertures therethrough adapted to operably mate to the plurality of threaded rod members, said spacer means operably engaged so as to permit free movement of said sliding bearing plate secured to the bottom of said building structural support column;

(c) capping plates having a plurality of apertures therethrough to mate with said rod members, said capping members being larger in size than said spacer means, whereby said sliding bearing base of said mounting post is restricted to movement only along the longitudinal axis of said flexural member attached to it; and (d) nuts for threadable engagement with said thread rod members to captively secure said base plate, spacer means and capping members in intimate fixed relationship to one another.

13. The improved building support system of claim 1, further comprising end termination means for said flexural members, including:

(a) a first steel plate capping the end of said flexural member and welded thereto;

(b) a steel flange member one end of which is welded mediately of said first steel plate and having an aperture therethrough on said opposite, unwelded end forming a mounting flange;

(c) a second steel plate, one end of which is welded to said first steel plate, and the opposite end is welded to the steel flange member;

(d) a third steel plate, one of which is welded to the end of said first steel plate opposite the weldment between said second and first steel plates and the opposite end of which is welded to the side of said flange member weldment to said second steel plate to provide a rugged, durable pivotal attached means.

* * * * *